US006478347B1

(12) United States Patent
Timothy

(10) Patent No.: US 6,478,347 B1
(45) **Date of Patent: *Nov. 12, 2002**

(54) WIND-RESISTANT SWEEP LOCK

(75) Inventor: E. Erik Timothy, Macedon, NY (US)

(73) Assignee: Caldwell Manufacturing Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/567,926

(22) Filed: May 10, 2000

(51) Int. Cl.[7] ..... E05C 3/04
(52) U.S. Cl. ..... 292/241
(58) Field of Search ..... 292/240, 241, 292/242, DIG. 47, DIG. 53; 403/340, 339

(56) References Cited

U.S. PATENT DOCUMENTS

| | | | | | |
|---|---|---|---|---|---|
| 526,386 | A | | 9/1894 | Elting | |
| 2,422,723 | A | | 6/1947 | Fisher | 292/204 |
| 2,613,526 | A | * | 10/1952 | Holmsten | 292/241 X |
| 3,306,644 | A | | 2/1967 | Larsen | 292/241 |
| 3,469,877 | A | | 9/1969 | Hutchison | 292/241 |
| 3,645,573 | A | | 2/1972 | Strang | 292/241 |
| 3,811,718 | A | | 5/1974 | Bates | 292/241 |
| 4,050,724 | A | | 9/1977 | Nakanishi | 292/241 |
| 4,436,328 | A | * | 3/1984 | Chernosky | 292/67 |
| 4,736,972 | A | * | 4/1988 | Mosch | 292/204 |
| 4,801,164 | A | | 1/1989 | Mosch | 292/204 |
| 5,219,193 | A | | 6/1993 | Piltingsrud | 292/240 |
| 5,454,609 | A | | 10/1995 | Slocomb et al. | 292/337 |
| 5,582,445 | A | | 12/1996 | Olsen et al. | 292/241 |
| 5,715,631 | A | | 2/1998 | Kailian et al. | 49/450 |
| 5,741,032 | A | | 4/1998 | Chaput | 292/202 |
| 5,769,469 | A | * | 6/1998 | Zemke | 292/241 |
| 6,079,754 | A | * | 6/2000 | Alexy | 292/101 |
| 6,116,665 | A | * | 9/2000 | Subliskey | 292/241 |
| 6,142,541 | A | * | 11/2000 | Rotondi | 292/241 |

FOREIGN PATENT DOCUMENTS

| | | | | |
|---|---|---|---|---|
| AU | 101174 | * | 7/1936 | 292/241 |
| AU | 117836 | * | 12/1943 | 292/241 |
| DE | 2140313 | * | 4/1972 | 292/241 |

* cited by examiner

*Primary Examiner*—Robert J. Sandy
*Assistant Examiner*—Dinesh Melwani
(74) *Attorney, Agent, or Firm*—Eugene Stephens & Associates

(57) ABSTRACT

A sweep lock locking the check rails of an upper and lower sash improves window resistance to negative wind force. The lock accomplishes this by a cam with a locking rim that extends both upward and downward to engage cam receiver projections above and below the locking rim to lock along two vertically separated locking lines, which tends to resist sash tilting from vertical as sash are deformed in response to negative wind force. Preferred embodiments of a cam lock and mounting hub include a two-piece hub that snaps together within a rotational opening of the cam lock to form a subassembly ready for mounting.

31 Claims, 5 Drawing Sheets

WIND-RESISTANT SWEEP LOCK

TECHNICAL FIELD

Window sash locks.

BACKGROUND

Sweep locks are well-established mechanisms for locking together upper and lower sash of a window. They use pivotally mounted cams interlocking with cam receivers, and the cams and receivers are mounted on adjacent check rail regions of lower and upper sash. When a sweep lock is locked, it prevents the upper sash from lowering or the lower sash from raising; and it also tends to hold the confronting check rails or meeting rails of the upper and lower sash together.

Sweep locks can also be applied to sash that slide horizontally within a window. This changes the orientation of the sweep lock and the sash, because the lock is applied to overlapping but vertically extending sash elements. The window industry generally retains the terms "check rails" or "meeting rails" for the overlapping elements of horizontally sliding sash, even though the vertical orientation would suggest that such elements might be called stiles.

Throughout the following explanation of the invention, it should be understood that a sweep lock can be applied to either vertically moving or horizontally moving sash. This leads to orientation of the sweep lock and its components in an "upright" way as described in this specification when applied to horizontally extending check rails of vertically moving sash and in a "sideways" way when mounted on the vertical check rails of horizontally sliding sash.

SUMMARY OF THE INVENTION

I have learned from wind force experiments that a conventional sweep lock leaves a window vulnerable to large pressure differences caused by high velocity winds. Subjecting windows to destructive wind force has shown the check rail region to be a zone of weakness. Negative wind force, for example, causing check rails to bow outward, which can happen during a wind storm, can shatter both of the window sash, in spite of a locked sweep lock. This can also lead to a conventional sweep lock becoming unlocked, which facilitates window failure.

This discovery has led to an improved sweep lock that more firmly locks together check rails of a pair of sash. My improved sweep lock more strongly resists tilting or angular separation of check rails as they are bowed outward in response to a negative wind force, and this significantly strengthens the check rail region and enhances the ability of a pair of window sash to survive a wind storm.

My wind-resistant sweep lock uses a locking cam that locks against an upward facing projection of a cam receiver while also locking against a downward facing projection of the cam receiver so that spaced-apart upward and downward locking between the cam and the cam receiver strengthens the locking of the check rails. Such a double upward and downward interlock between the cam and the cam receiver creates a locking moment arm that resists angular separation of confronting faces of the upper and lower sash check rails. In other words, such a double locking more effectively resists tilting of the check rails away from vertical, or from each other, in response to wind force. This in turn significantly strengthens the check rail region of the window and allows the window to survive in tact while subject to large negative wind force.

While working out an efficient way of structuring and mounting a sweep lock to achieve these advantages, I have also discovered an especially effective mount for the locking cam of a sweep lock. The mount is inexpensive, assures a convenient subassembly of cam lock and mount, and also provides uniform frictional movement of the cam lock during operation.

DRAWINGS

FIG. 1 schematically illustrates a conventional sweep lock allowing tilting of sash check rails in response to outward bowing from negative wind force.

FIG. 2 schematically illustrates the inventive sweep lock resisting tilting of sash check rails in response to outward bowing from negative wind pressure.

DETAILED DESCRIPTION

Figure 1:
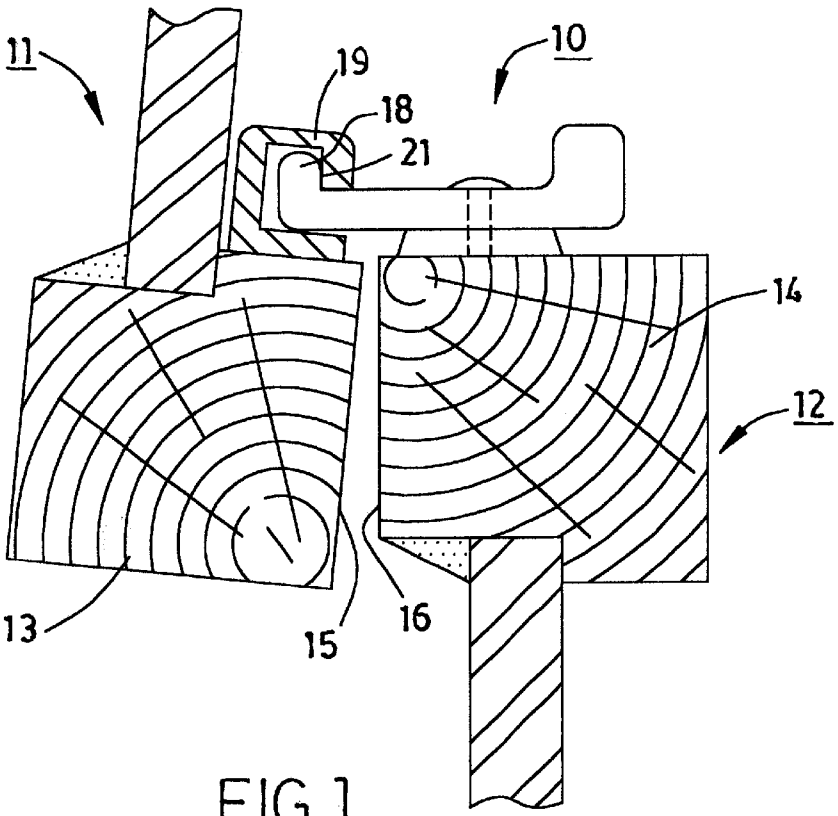
FIG. 1 PRIOR ART

When a window with a pair of sash 11 and 12 is subject to strong negative wind pressure, the sash bend and bow outwardly as schematically illustrated in the prior art view of FIG. 1. This shows a fragment of a check rail region of the sash in the center of the window where sweep lock 10 locks the check rails together. As it bends or bows outward, check rail 13 of sash 11 tends to incline from a vertical plane as illustrated in FIG. 1. At the same time, outward bowing of check rail 14 of sash 12 also inclines from a vertical plane, as illustrated. This produces an angular separation between confronting faces 15 and 16 of check rails 13 and 14.

The inclination of check rails 13 and 14 from vertical and the resulting angular separation of check rail faces 15 and 16 are permitted by the way locking cam 18 of conventional sweep lock 10 interlocks with cam receiver 19 along a single locking line 21 where receiver 19 and cam lip 18 lockingly interengage. This single line interlock tends to hold the tops or locked edges of check rails 13 and 14 together, but offers little resistance to separation of the bottoms or unlocked edges of check rails 13 and 14 along the lower regions of confronting surfaces 15 and 16. In turn, the relative freedom of check rails 13 and 14 to tilt from vertical as they are bowed outward to introduce an angular separation between confronting faces 15 and 16 allows sash deformity that leaves the sash more vulnerable to shattering. This sort of deformation can also allow some prior art sweep locks to come unlocked, which in turn facilitates window failure.

The problem described above was discovered during many wind tests of windows that were subjected to negative wind force sufficient to shatter sash 11 and 12. The tests showed that the central check rail region where the sash were locked together was a region of weakness in resisting negative wind force.

Figure 2:
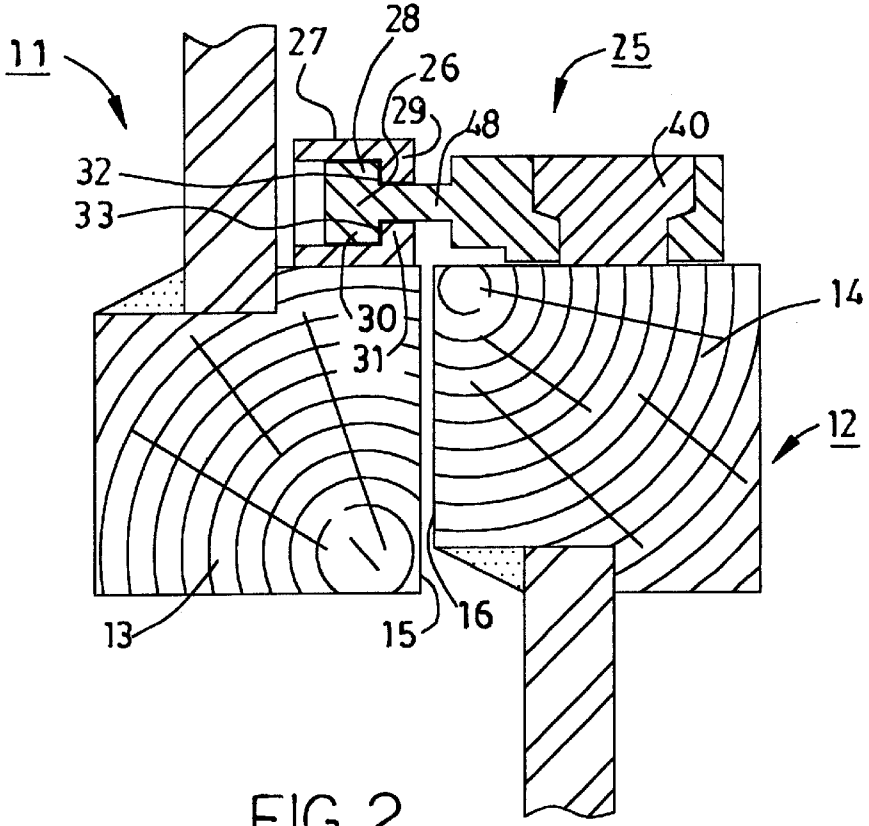

From this information, I was able to devise a more wind-resistant sweep lock as schematically illustrated in FIG. 2. Here, a pair of sash 11 and 12 are subjected to the same negative wind force as applied in FIG. 1, with the difference in result being caused by the more effective interlock between check rails 13 and 14 caused by the inventive sweep lock 25.

As mentioned above, sash 11 and 12 can be mounted either for moving vertically or sliding horizontally. Since the vertical motion arrangement is commonplace, it is convenient here to explain the operation of the inventive sweep lock in terms of horizontal check rails and up and down movement directions relating to double hung sash. The reader must understand, though, that the orientations of sweep lock components automatically change 90° from the described ones, when the sweep lock is used to lock check rails of horizontally sliding sash.

Lock 25, as shown in more detail in FIGS. 3–15 illustrating preferred embodiments, includes a locking cam 26 and a cam receiver 27. The interlock between these two, instead of occurring along a single line, occurs along spaced-apart upper and lower lines 32 and 33. An upward facing rim 28 of locking cam 26 interlocks with downward facing projection 29 of cam receiver 27 along line 32 in a generally familiar way; but in addition to this, a downward facing rim 30 of locking cam 26 interlocks with an upward facing projection 31 of cam receiver 27 along line 33. The locking line 33 between cam rim 30 and projection 31 occurs below locking line 32 between cam rim 28 and receiver projection 29 so that these two locking lines are vertically separated. This establishes a locking moment arm that resists angular departure of either check rail 13 or 14 from vertical. Upper and lower locking lines 32 and 33 also 35 establish a locking locus extending generally vertically, and this resists any tilting of check rails 13 and 14. This also reduces any angular separation between check rails 13 and 14 and holds confronting surfaces 15 and 16 closer together, even when the upper and lower sash are bowed in response to negative wind force. This result stiffens sash 11 and 12 against deformation and improves their resistance to shattering. The double up and down lock provided by sweep lock 25 thus helps upper and lower sash 11 and 12 resist negative wind force and makes the window stronger and more secure.

Figure 3:
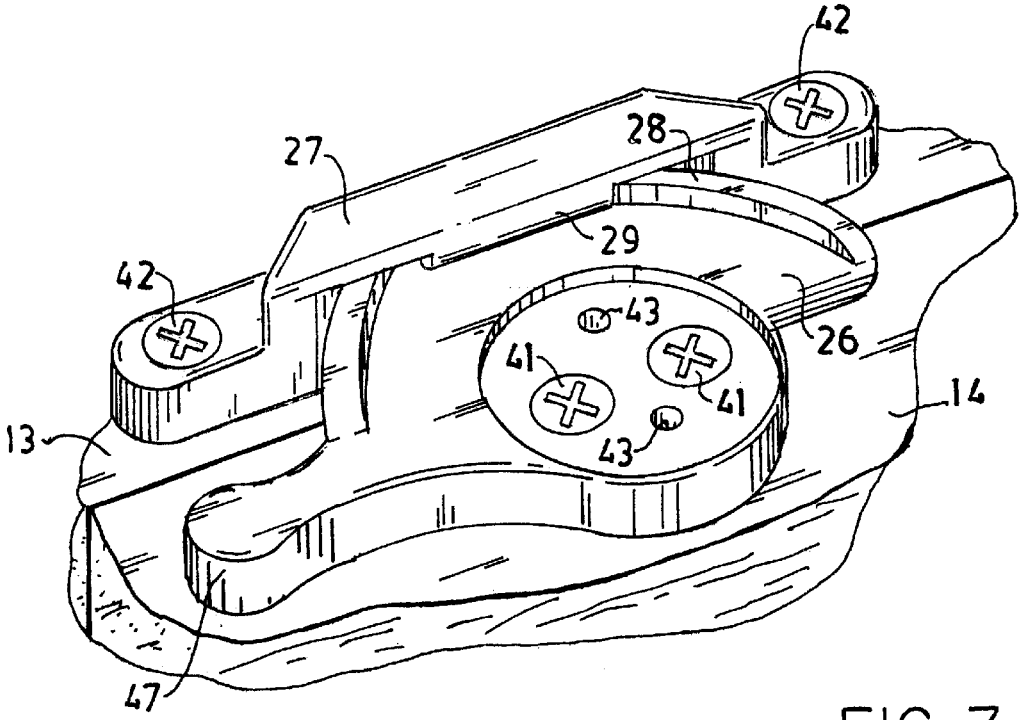
FIGS. 3 and 4 show isometric views of a preferred embodiment of my sweep lock shown in locked position in FIG. 3 and unlocked position in FIG. 4.
Figure 4:
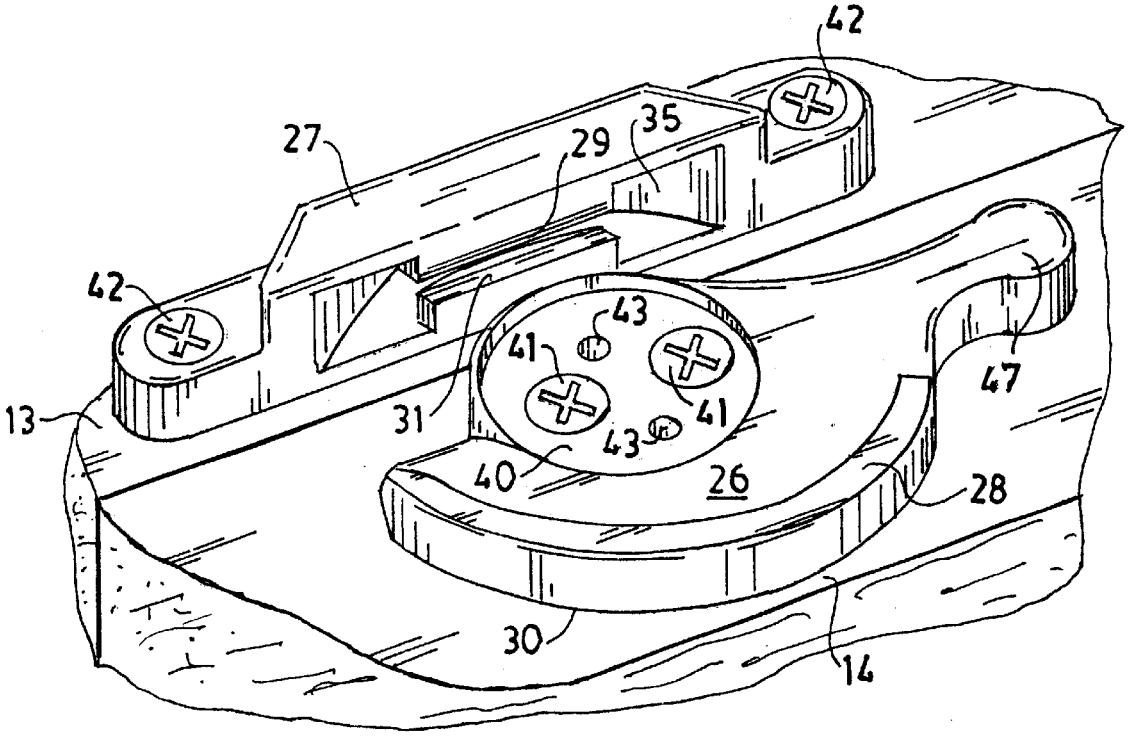
Figure 5:
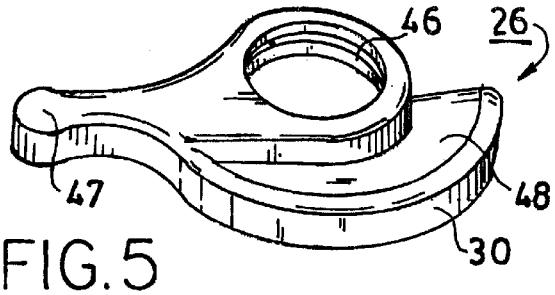
FIGS. 5 and 6 are isometric views of a locking cam portion of my sweep lock illustrating a bottom face in FIG. 5 and a top face in FIG. 6.

The isometric views of FIGS. 3 and 4 illustrate a preferred embodiment of the invention in more detail. Cam receiver 27 is preferably formed with a curved recess 35 to receive locking rims 28 and 30 of locking cam 26. Rotation for cam 26 is provided by a circular disk or element 40 that is preferably secured to an upper surface of lower check rail 14 to hold cam 26 rotationally in place. Screws 41 secure disk 40 to check rail 14, and screws 42 secure cam receiver 27 preferably to an upper surface of check rail 13. A pair of recesses 43 in circular element 40 receive studs 44 on decorative cap 45 (shown in FIGS. 11 and 12), which can be mounted on top of disk 40 to conceal screws 41.

The structures of locking cam 26, cam receiver 27, mounting element 40, and cap 45 facilitate molding of all of these parts. They can be molded using many different molding techniques and can be formed of resin, composite materials, or metal.

Individual parts for the preferred embodiment of my sweep lock are illustrated in FIGS. 5–12. These show locking cam 26 in FIGS. 5 and 6 with a central recess 46 dimensioned to mount around circular disk 40 and with a handle 47 to rotate cam 26. Web 48 extends radially outward around central opening 46 to support cam rims 28 and 30, which extend respectively above and below web 48.

Figure 7:
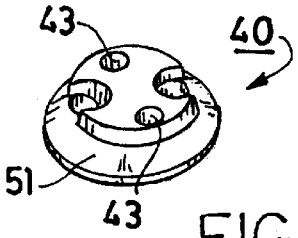
FIGS. 7 and 8 illustrate a mounting disk for the locking cam of FIGS. 5 and 6 showing the bottom of the locking disk in FIG. 7 and the top of the locking disk in FIG. 8.
Figure 6:
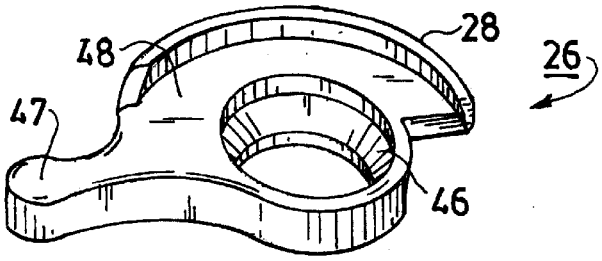
Figure 8:
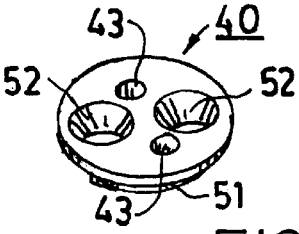

Circular element 40 is shown in the bottom perspective view in FIG. 7 and in the top perspective view in FIG. 8 to reveal a circular periphery 51 that can engage and hold locking cam 26. Disk 40 is molded with holes 52 to receive mounting screws 41 (FIG. 4). Molded recesses 43 receive studs 44 of decorative cover cap 45, illustrated in FIGS. 11 and 12.

Figure 9:
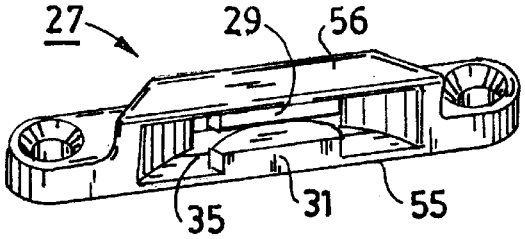
FIGS. 9 and 10 show respective isometric top and bottom views of a cam receiver for the locking cam of FIGS. 5 and 6.
Figure 11:
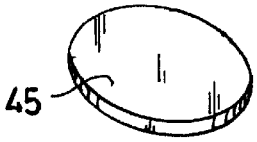
FIGS. 11 and 12 show respective top and bottom views of a decorative cap that can be snap-fit over the mounting disk of FIGS. 7 and 8.
Figure 10:
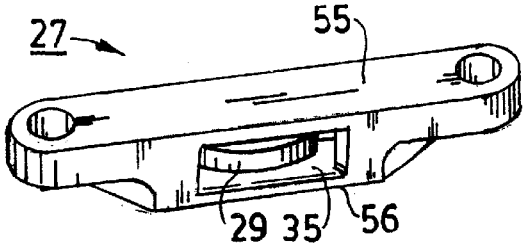
Figure 12:
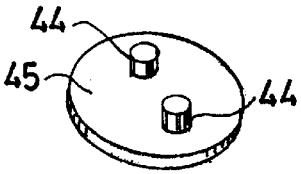

Cam receiver 27 is shown in a top perspective view of FIG. 9 and a bottom perspective view of FIG. 10. These reveal a lower support 55 and an upper support 56 respectively below and above recess 35 and respectively supporting downward facing upper projection 29 and upward facing lower projection 31. These respectively engage upper rim 28 and lower rim 30 of locking cam 26 to provide the previously explained upper and lower locking lines that increase the wind resistance of window sash.

The embodiment of FIGS. 13–16, which is also preferred, involves a two-piece hub 60 formed of preferably identical parts 61 that can be fitted together to form a rotational support for locking cam 70. Cam 70 is similar to cam 26 and preferably includes a lower locking rim 71 and a upper locking rim 72 to take advantage of the double-locking strength provided by the invention.

Figure 13:
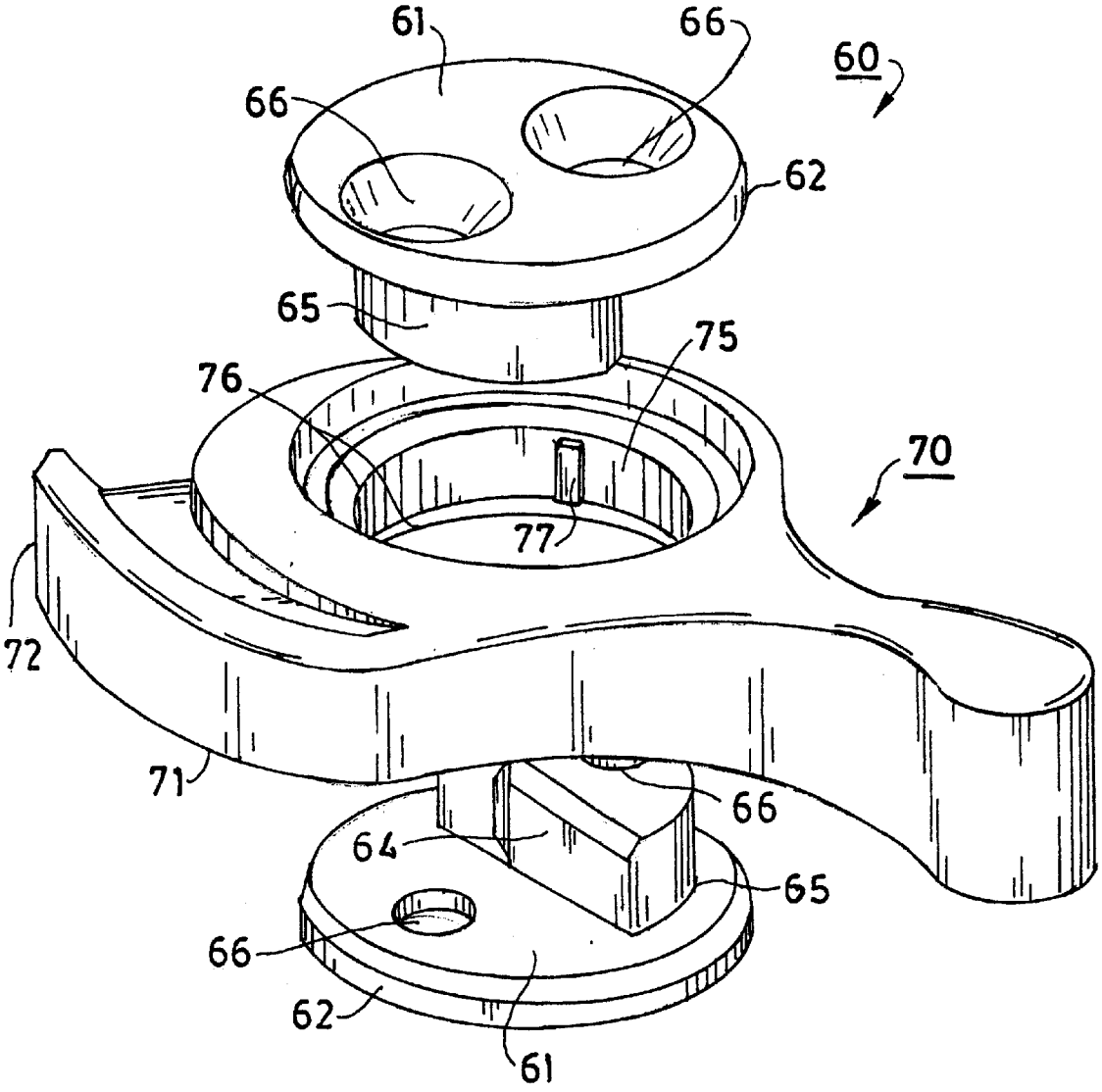
FIG. 13 is an exploded isometric view of a preferred embodiment of a two-piece mounting hub for a cam lock according to the invention.
Figure 15:
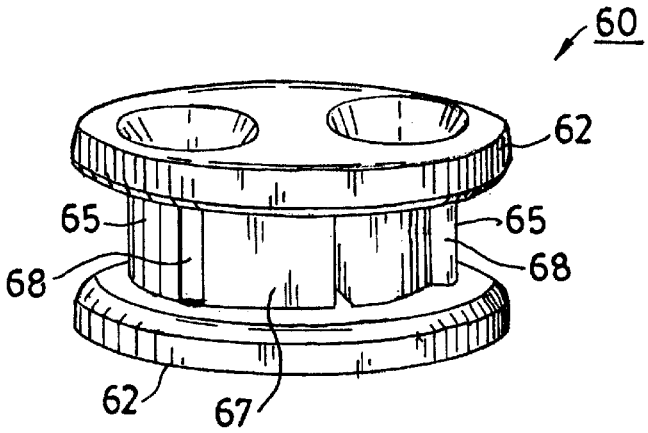
FIG. 15 is an isometric view of the hub pieces of FIG. 14 fitted together to form a supporting hub for a cam lock such as shown in FIG. 13.
Figure 16:
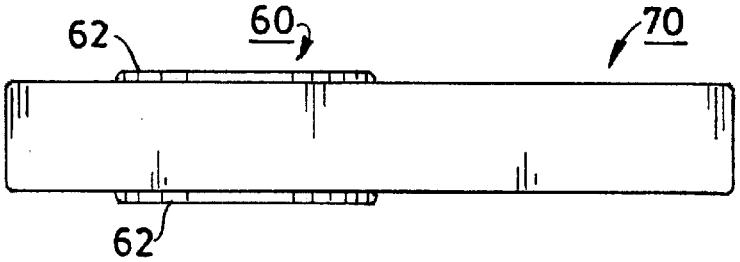
FIG. 16 is an elevational view of an assembly of the locking cam and two-piece hub of FIGS. 13–15 for mounting on a sash check rail.

The two-piece hub 60 is preferably formed so that hub pieces 61 can snap-fit together within circular opening 75 of locking cam 70 to form a subassembly shown in exploded form in FIG. 13 and in elevation in FIG. 16. The assembled hub 60, without locking cam 70, is shown in FIG. 15.

Figure 14:
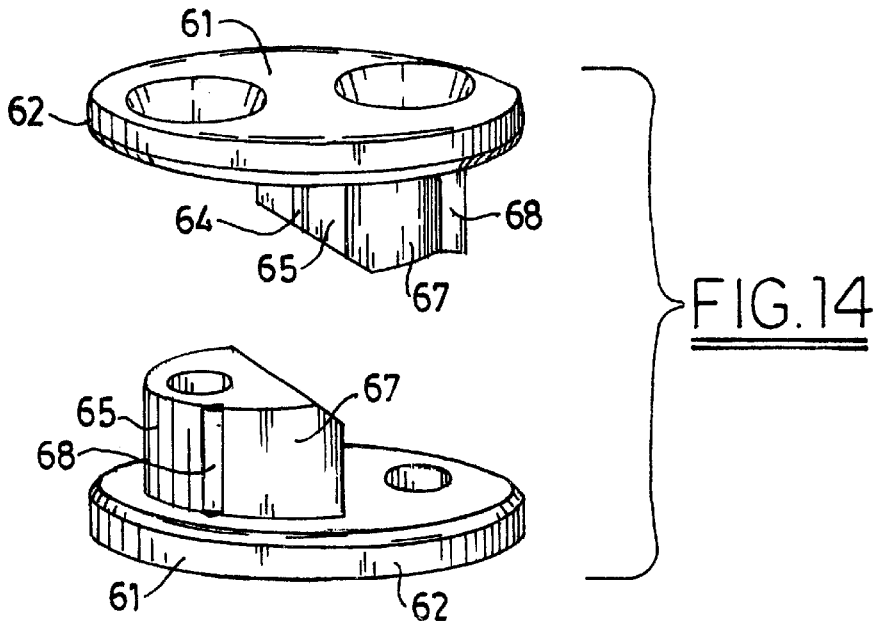
FIG. 14 is an exploded isometric view of the two-piece hub of FIG. 13.

Each hub piece 61 preferably has a circular flange 62 and a generally semi-cylindrical hub portion 65. A snap interlock 64 is preferably formed on a confronting face of each hub portion 65 so that when these are fitted together as shown in FIGS. 14 and 15, they snap together within circular opening 75 of cam lock 70 to form a subassembly. Once snapped together within opening 75, hub portions 61 are not readily separated; and by holding themselves together, hub portions 61 also retain cam lock 70 rotationally mounted on hub 60. Flanges 62 rest in grooves 76 of opening 75 so that they preferably extend somewhat above and below cam lock 70, as shown in FIG. 16. This allows cam 70 and hub 60 to be mounted either side up, with cam 70 rotationally clearing a check rail surface on which hub 60 is mounted.

Each of the hub portions 61 preferably has a pair of apertures 66 formed to receive mounting screws; and when hub portions 65 are fitted together as shown in FIG. 15, screw holes 66 align so that a pair of mounting screws (not shown) can pass through each hub portion 61, for mounting hub 60 and cam lock 70 in place. Since cam lock 70 is preferably subassembled onto hub 60, with its snap-together portions 61, all that is necessary for mounting cam lock 70 in operative position is to drive screws through holes 66 into an upper surface of a check rail, preferably of a lower sash.

Cam lock 70 is preferably formed with a rotational stop 77 in circular opening 75, and generally semi-cylindrical hub portions 65 are preferably formed with a corresponding arcuate recess 67 that can rotate freely past rotational stop 77. End walls 68 of recesses 67 are preferably separated by an operational arc sufficient for moving cam lock 70 between locked and unlocked positions. End walls 68 engage rotational stop 77 to prevent cam rotation beyond the working arc provided by recesses 67.

Once hub portions 61 are snapped together within cam opening 75 to form a subassembly, they also establish the rotational friction required to rotate cam lock 70 between rotational stops resulting from engagement of stop 77 with hub recess end walls 68. Since flanges 62 extend somewhat above and below top and bottom surfaces of cam lock 70, as shown in FIG. 16, hub 60 mounts cam lock 70 rotationally clear of a check rail surface. The force required to overcome rotational friction for cam lock 70 is thus established by the subassembly of hub parts 61 within cam lock opening 75 and is not affected by the check rail surface on which the subassembly is secured.

I claim:

1. A sweep lock formed of a locking cam secured to a check rail of one sash and a cam receiver secured to a check rail of another sash, the sweep lock comprising:

a. the locking cam having a web extending radially outward from a pivot region to a peripheral cam region;

b. the peripheral cam region having a cam rim extending perpendicular to the radial web and beyond both face sides of the radial web;

c. the cam receiver having a pair of confronting lock projections separated by a space that receives the cam web so that one of the lock projections engages a radially inward facing surface of the cam rim on one side of the web and a lower one of the lock projections engages a radially inward facing surface of the cam rim on an opposite side of the web; and d. a lever arm on the locking cam for rotating the locking cam.

2. The sweep lock of claim 1 wherein the pivot region of the cam is a circular opening pivoting on a circular hub secured to the one sash to mount the cam.

3. The sweep lock of claim 2 wherein the circular hub is formed of two identical pieces that are snap-fit together to locate the circular hub axially between opposed flanges securing the locking cam rotationally in place on the hub.

4. The sweep lock of claim 1 wherein the confronting lock projections extend toward each other from supports that are separated by enough to receive the cam rim.

5. A wind-resistant sweep lock comprising:

a cam with lever arm, the cam being pivotally mounted on a check rail of a lower sash for passing between and engaging upper and lower lock projections on a cam receiver mounted on a check rail of an upper sash so that a downward facing rim of the cam locks against an upward facing projection of the cam receiver and an upward facing rim of the cam locks against a downward facing projection of the cam receiver, the lock between the downward facing rim of the cam and the upward facing projection of the cam receiver adding substantially to wind resistance of the upper and lower sash that is achievable solely by the lock between the upward facing rim of the cam and the downward facing projection of the cam receiver.

6. The sweep lock of claim 5 wherein the cam. has a web extending radially inward from the upward and downward facing rims.

7. The sweep lock of claim 5 wherein the cam is pivotally mounted on a hub formed of two pieces fitted together to dispose the hub within a circular opening of the cam and dispose upper and lower flanges of the hub adjacent upper and lower surfaces of the cam.

8. The sweep lock of claim 7 wherein the cam has a web extending radially from the circular element to the upward and downward facing rims.

9. The sweep lock of claim 5 wherein the upward and downward facing cam rims have equivalent cam profiles.

10. The sweep cam of claim 5 wherein the lock receiver has spaced apart upper and lower supports for the upward and downward facing projections.

11. The sweep lock of claim 10 wherein the supports are separated by enough to receive the upward and downward facing cam rims.

12. A wind-resistant check rail lock between upper and lower sash, the lock comprising:

a locking cam with lever arm, where the locking cam locks against an upward facing projection of a cam receiver while also locking against a downward facing projection of the cam receiver so that spaced-apart upward and downward locking between the cam and the cam receiver creates a locking moment arm that resists angular separation of confronting faces of upper and lower sash check rails as the sash are bowed in response to wind pressure.

13. The lock of claim 12 wherein the upward and downward locking occurs between a rim of a locking cam and cam receiver projections extending upward and downward from receiver supports.

14. The lock of claim 12 wherein the locking cam is mounted to pivot around a circular two-piece hub secured to a sash.

15. The lock of claim 12 wherein the upward and downward facing projections of the cam receiver are spaced apart to receive a web supporting a rim of the locking cam.

16. A sweep lock having a cam that pivots around a circular opening for rotation into and out of locked relation with a cam receiver, the sweep lock comprising:

a. the cam having a rim extending perpendicularly beyond both faces of a web supporting the cam rim around a pivot region;

b. the cam receiver having a gap between a pair of supports spaced apart sufficiently to receive the cam rim;

c. a pair of confronting lock projections extending respectively from the supports toward the cam web;

d. the lock projections being disposed to engage radially inward faces of the cam rim on respective opposite sides of the cam web;

e. the lock projections being spaced apart sufficiently to receive the cam web;

f. a mount for the cam formed of two pieces fitted together;

g. each of the mount pieces having semi-cylindrical portions configured so that when the pieces are fitted together, the semi-cylindrical portions approximately form a cylinder occupying the circular opening of the cam; and h. each of the mount pieces having a generally circular flange disposed so that when the mount pieces are fitted together within the circular opening of the cam, the flanges are arranged adjacent opposite surfaces of the cam.

17. The sweep lock of claim 16 wherein the mount pieces have apertures formed to receive screws securing the mount pieces to a check rail of a sash to support the cam for rotation clear of the check rail.

18. The sweep lock of claim 17 wherein the cam mount pieces are snapped together within the circular opening to retain the cam on the hub.

19. A wind-resistant lock connecting overlapping regions of a pair of window sash, the lock comprising:

a. a locking cam with an actuating lever arm and a cam receiver arranged so that the cam interlocks with the receiver along a pair of locking lines spaced apart on opposite sides of the cam; and b. the spaced-apart locking lines defining a locking locus extending in a direction of sliding movement of the sash to resist tilting of the overlapping regions away from the movement direction in response to wind force applied to the sash.

20. The lock of claim 19 including a two-piece hub assembled to support the cam pivotally on the hub between opposed hub flanges.

21. The lock of claim 19 wherein the spaced-apart locking lines occur between opposed receiver projections engaging a rim of the cam on opposite sides of a web supporting the cam rim.

22. A sweep lock cam and mount comprising:

the cam having a circular opening around which the cam rotationally pivots;

b. the mount being formed of two parts that snap together to form a hub occupying the circular opening to support the cam for rotation;

c. each of the mount parts having a circular flange disposed so that when the mount parts are snapped together, the circular flanges are arranged adjacent opposite surfaces of the cam; and d. the mount having apertures receiving screws that secure the mount to a sash and support the cam for rotational movement clear of the sash.

23. The cam and mount of claim 22 wherein the circular opening in the cam is formed with a rotational stop, and the mount parts when snapped together form a hub recess establishing arcuate limits for the rotational stop so that the cam rotates around the hub from one rotational limit to another.

24. The cam and mount of claim 22 wherein the mount parts when snapped together form an assembly retaining the mount parts and the cam together for mounting on a sash.

25. A subassembly of a sweep lock cam and mount comprising:

a. the cam having a generally circular opening around which the cam rotates for locking and unlocking purposes;

b. the mount being formed. of two identical pieces each of which includes one-half of a hub disposed so that when the pieces are fitted together within the circular opening, they form a hub around which the cam rotates; and c. the mount having a surface extending beyond a surface of the cam so that the mount, when secured to a sash, supports the cam for rotation clear of the sash.

26. The cam and mount of claim 25 wherein the circular opening in the cam includes a rotation stop projection, and the hub of the mount includes an arcuate recess within limits of which the rotational stop is free to rotate.

27. The cam and mount of claim 25 wherein the mount pieces have opposite circular flanges disposed respectively adjacent opposite surfaces of the cam.

28. The cam and mount of claim 25 wherein each piece of the mount has a pair of apertures that align when the mount pieces are fitted together to receive a pair of mounting screws for fastening the mount to a sash.

29. A sweep lock having a cam that pivots around a circular opening for rotation into and out of locked relation with a cam receiver, the sweep lock comprising:

a. a mount for the cam formed of two pieces fitted together;

b. each of the mount pieces having semi-cylindrical portions configured so that when the pieces are fitted together, the semi-cylindrical portions approximately form a cylinder occupying the circular opening of the cam; and c. each of the mount pieces having a generally circular flange disposed so that when the mount pieces are fitted together within the circular opening of the cam, the flanges are arranged adjacent opposite surfaces of the cam.

30. The sweep lock of claim 29 wherein the mount pieces have apertures formed to receive screws securing the mount pieces to a sash to support the cam for rotation clear of the sash.

31. The sweep lock of claim 30 wherein the cam mount pieces are snapped together within the circular opening to retain the cam on the hub.

* * * * *